US009089986B2

(12) United States Patent
Kehoe et al.

(10) Patent No.: US 9,089,986 B2
(45) Date of Patent: Jul. 28, 2015

(54) DRAW STUD CONNECTOR

(75) Inventors: Sean T. Kehoe, Waukesha, WI (US); James O. Myrhum, Jr., West Bend, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 290 days.

(21) Appl. No.: 13/591,563

(22) Filed: Aug. 22, 2012

(65) Prior Publication Data

US 2013/0047813 A1 Feb. 28, 2013

Related U.S. Application Data

(60) Provisional application No. 61/526,062, filed on Aug. 22, 2011, provisional application No. 61/526,140, filed on Aug. 22, 2011, provisional application No. 61/592,966, filed on Jan. 31, 2012.

(51) Int. Cl.

| | |
|---|---|
| ***B26D 7/26*** | (2006.01) |
| ***B21D 28/34*** | (2006.01) |
| *B26F 1/40* | (2006.01) |

(52) U.S. Cl.

CPC ..... *B26D 7/26* (2013.01); *B21D 28/343* (2013.01); *B26F 1/40* (2013.01)

(58) Field of Classification Search

CPC ..... B26F 1/40; B26D 7/26; B26D 5/00; B26D 7/00; B21D 28/346; B21D 22/00

USPC ..... 83/513, 515, 518, 681, 682, 684, 83/698.91; 403/171

See application file for complete search history.

(56) References Cited

U.S. PATENT DOCUMENTS

| | | | | | |
|---|---|---|---|---|---|
| 1,151,032 | A | * | 8/1915 | Moore | 83/123 |
| 1,279,362 | A | * | 9/1918 | Krueger | 83/690 |
| 1,583,715 | A | * | 5/1926 | Houston | 30/331 |
| 1,726,012 | A | | 8/1929 | Bilz | |
| 2,448,817 | A | * | 9/1948 | McArthur | 403/321 |
| 2,536,452 | A | * | 1/1951 | Leissler | 175/45 |
| 2,608,253 | A | | 8/1952 | Battles et al. | |
| 2,634,987 | A | * | 4/1953 | Palmer | 280/512 |
| 2,808,108 | A | * | 10/1957 | Pellegrino | 279/76 |
| 2,991,601 | A | * | 7/1961 | Glatter et al. | 53/432 |
| 3,269,011 | A | | 8/1966 | Herrstrum | |
| 3,288,501 | A | * | 11/1966 | Ross et al. | 403/74 |
| 3,335,627 | A | * | 8/1967 | Smelts | 83/140 |
| 3,548,700 | A | * | 12/1970 | Herzog et al. | 83/698.91 |
| 3,640,364 | A | | 2/1972 | Utton | |
| 3,935,771 | A | * | 2/1976 | Cady, Jr. | 83/140 |
| 4,495,699 | A | | 1/1985 | Oakes | |
| 4,594,779 | A | * | 6/1986 | Hagemeyer | 30/360 |
| 4,793,063 | A | | 12/1988 | Ducret | |
| 4,899,447 | A | | 2/1990 | Adleman | |
| 4,905,557 | A | | 3/1990 | Adleman | |
| 5,020,407 | A | * | 6/1991 | Brinlee | 83/530 |
| 5,056,391 | A | * | 10/1991 | Stewart | 83/139 |

(Continued)

*Primary Examiner* — Sean Michalski

(74) *Attorney, Agent, or Firm* — Michael Best & Friedrich LLP

(57) ABSTRACT

A draw stud connector for use on a punch driver having a working piston. The draw stud connector including a draw stud having a first end, and a first member removably couplable to the working piston and defining an axis therethrough. The first member also defines a recess shaped such that the first end of the draw stud can be introduced and removed radially from the recess, but the first end cannot be removed axially from the recess.

22 Claims, 25 Drawing Sheets

(56) References Cited

U.S. PATENT DOCUMENTS

| | | | | |
|---|---|---|---|---|
| 5,190,392 | A * | 3/1993 | Parma et al. | 403/171 |
| 5,271,303 | A * | 12/1993 | Chatham | 83/136 |
| 5,342,155 | A * | 8/1994 | Harroun | 409/131 |
| 5,405,347 | A * | 4/1995 | Lee et al. | 606/54 |
| 5,425,558 | A | 6/1995 | Dennany, Jr. | |
| 5,593,265 | A | 1/1997 | Kizer | |
| 5,626,433 | A * | 5/1997 | Iwamoto | 403/76 |
| 5,647,256 | A * | 7/1997 | Schneider | 83/140 |
| 5,833,383 | A * | 11/1998 | Bauman | 403/122 |
| 5,911,800 | A | 6/1999 | Roberts et al. | |
| 6,047,621 | A * | 4/2000 | Dries et al. | 83/136 |
| 6,126,359 | A | 10/2000 | Dittrich et al. | |
| 6,148,710 | A * | 11/2000 | Pottorff | 83/682 |
| 6,161,279 | A * | 12/2000 | Suboski | 29/798 |
| 6,209,208 | B1 * | 4/2001 | Marinkovich et al. | 30/392 |
| 6,279,445 | B1 * | 8/2001 | Rosene et al. | 83/698.91 |
| 6,305,889 | B1 | 10/2001 | Blessing et al. | |
| 6,485,218 | B1 * | 11/2002 | Martinovsky | 403/135 |
| 6,754,967 | B2 * | 6/2004 | Lovell et al. | 30/517 |
| 6,840,698 | B2 * | 1/2005 | Cattaneo | 403/170 |
| 6,860,670 | B2 * | 3/2005 | Jeffries | 403/122 |
| 6,877,927 | B2 | 4/2005 | Paulin et al. | |
| 6,953,197 | B2 | 10/2005 | Hartmann | |
| 7,090,700 | B2 * | 8/2006 | Curtis | 623/38 |
| 7,125,192 | B2 | 10/2006 | Yokota | |
| 7,316,404 | B1 | 1/2008 | Walker | |
| 7,698,979 | B2 * | 4/2010 | Sugizaki et al. | 83/140 |
| 7,726,554 | B2 * | 6/2010 | Thielges et al. | 234/43 |
| 7,927,036 | B2 * | 4/2011 | Reasoner | 403/341 |
| 7,980,781 | B2 | 7/2011 | Trice | |
| 8,007,196 | B2 | 8/2011 | Whitling et al. | |
| 8,327,745 | B2 * | 12/2012 | Lee et al. | 83/686 |
| 8,366,341 | B2 * | 2/2013 | Bevirt | 403/381 |
| 8,408,111 | B2 * | 4/2013 | Johnston et al. | 83/686 |
| 8,584,581 | B2 * | 11/2013 | Curtin | 99/588 |
| 8,657,594 | B2 * | 2/2014 | Atagi et al. | 425/78 |
| 8,714,065 | B2 * | 5/2014 | Takahashi et al. | 83/123 |
| 8,904,911 | B2 * | 12/2014 | Nordlin | 83/55 |
| 2002/0002775 | A1 | 1/2002 | Kimura | |
| 2002/0007714 | A1 * | 1/2002 | Ohtsuka et al. | 83/698.31 |
| 2004/0200333 | A1 * | 10/2004 | Seeley et al. | 83/698.91 |
| 2008/0011135 | A1 | 1/2008 | Ray | |
| 2008/0092713 | A1 * | 4/2008 | Takahashi et al. | 83/698.91 |
| 2008/0210076 | A1 | 9/2008 | Bublitz et al. | |
| 2009/0110477 | A1 * | 4/2009 | Seger | 403/376 |
| 2009/0224534 | A1 * | 9/2009 | Liu | 285/148.14 |
| 2010/0031492 | A1 * | 2/2010 | Lee et al. | 29/566.4 |
| 2010/0107832 | A1 * | 5/2010 | Johnston et al. | 83/13 |
| 2010/0180744 | A1 | 7/2010 | Nordlin | |
| 2013/0333578 | A1 * | 12/2013 | Lee et al. | 100/214 |

* cited by examiner

DRAW STUD CONNECTOR

CROSS-REFERENCE TO RELATED APPLICATION

This application claims the benefit of and priority to U.S. Provisional Patent Application No. 61/526,062 filed Aug. 22, 2011, U.S. Provisional Patent Application No. 61/526,140 filed Aug. 22, 2011, and U.S. Provisional Patent Application No. 61/592,966 filed Jan. 31, 2012. The entire contents of each of these applications are hereby incorporated by reference.

BACKGROUND OF THE INVENTION

The present invention relates to a knockout punch, and in particular to a draw stud connector for use with the knockout punch.

Typical knockout punch assemblies include a draw stud that is threadably attached to the working piston of the driver. These same applications generally also require that one of the punch or the die is also threadably attached to the opposite end. Since these threads are typically very fine in order to withstand the large load placed upon them during operation, this task can be exceedingly tedious when the worker is required to repeatedly assemble and disassemble the punch assembly (e.g., to punch multiple holes in rapid succession).

SUMMARY

In some embodiments, the present invention provides a draw stud connector for use on a punch driver having a working piston. The draw stud connector includes a draw stud having a first end. The draw stud also includes a first member removably couplable to the working piston and defining an axis therethrough, the first member also defines a recess shaped such that the first end of the draw stud can be introduced and removed radially from the recess, but the first end cannot be removed axially from the recess.

In other embodiments, the present invention provides a draw stud connector for use on a punch driver having a body and a working piston movable with respect to the body. The draw stud connector includes a first portion removably couplable to the working piston and defining an axis therethrough, the first portion defining a recess with a radial opening. The draw stud connector also includes a second portion removably couplable to the body of the piston and defining a cut out, where the second portion is rotatable between a first position, where the cut out at least partially aligns with the radial opening, and a second position, where the cut out does not align with the radial opening.

In still another embodiment, the present invention provides a draw stud connector for use on a punch driver. The draw stud connector includes a draw stud having a first end. The draw stud connector also includes a body defining an axis therethrough, the body forming a cavity having an open end, and a wedge at least partially positioned within the cavity and moveable with respect to the body both axially and radially. The wedge allows the first end of the draw stud to move axially into the cavity but does not permit axial removal of the first end of the draw stud from the cavity.

Before any independent embodiments of the invention are explained in detail, it is to be understood that the invention is not limited in its application to the details of embodiment and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
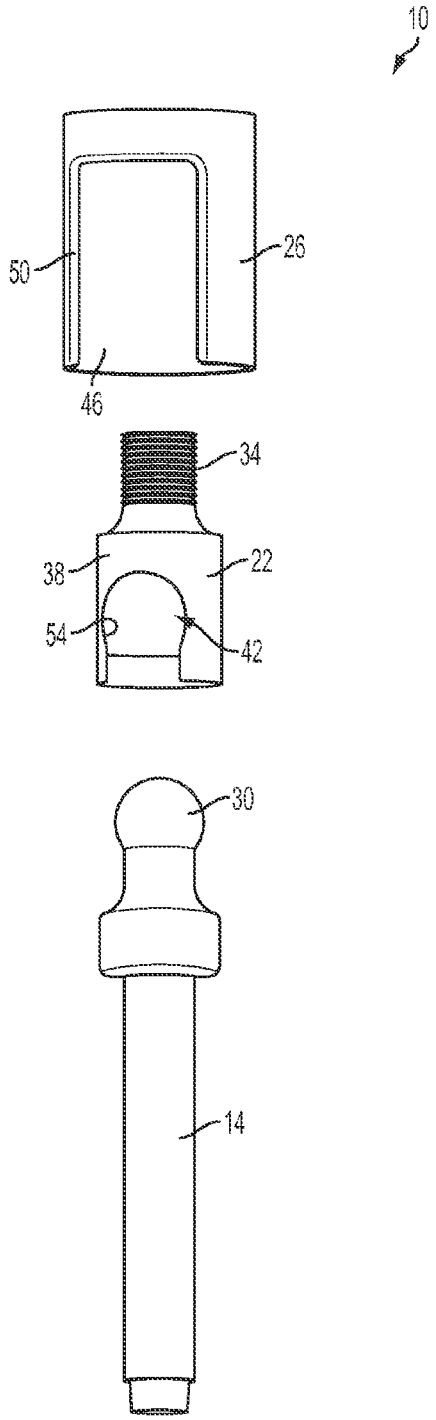
FIG. 1 is an assembly view of the draw stud connector according to one embodiment of the invention.

FIGS. 1-5 illustrate a draw stud connector 10 configured to coupled a draw stud 14 to a punching device, such as a knockout punch 18. The connector 10 includes a first cylindrical portion 22 and a second, larger cylindrical portion 26. The draw stud connector 10 is configured to be used with the draw stud 14, which has a ball or spherical shaped end 30 (FIG. 1). In the illustrated embodiment, the ball shaped end 30 may be attached as a separate connector or integrally formed with the draw stud 14.

The first cylindrical portion 22 of the connector 10 includes a threaded end 34, which is coupleable to a piston 24 of the knockout punch 18 (FIG. 3) such that the first portion 22 and the piston 24 move together. The first portion 22 also includes a body 38 defining a recess 42 therein. The recess 42 is substantially spherical in shape and is open both radially and axially. The recess 42 is shaped such that the ball end 30 of the draw stud 14 can be introduced and removed radially from the recess 42, but the ball end 30 cannot be removed axially. As such, any forces applied axially to the first portion 22 of the connector 10 are transmitted into the draw stud 14 (e.g., such as when the draw stud 14 is being drawn during the punching process).

Figure 2:
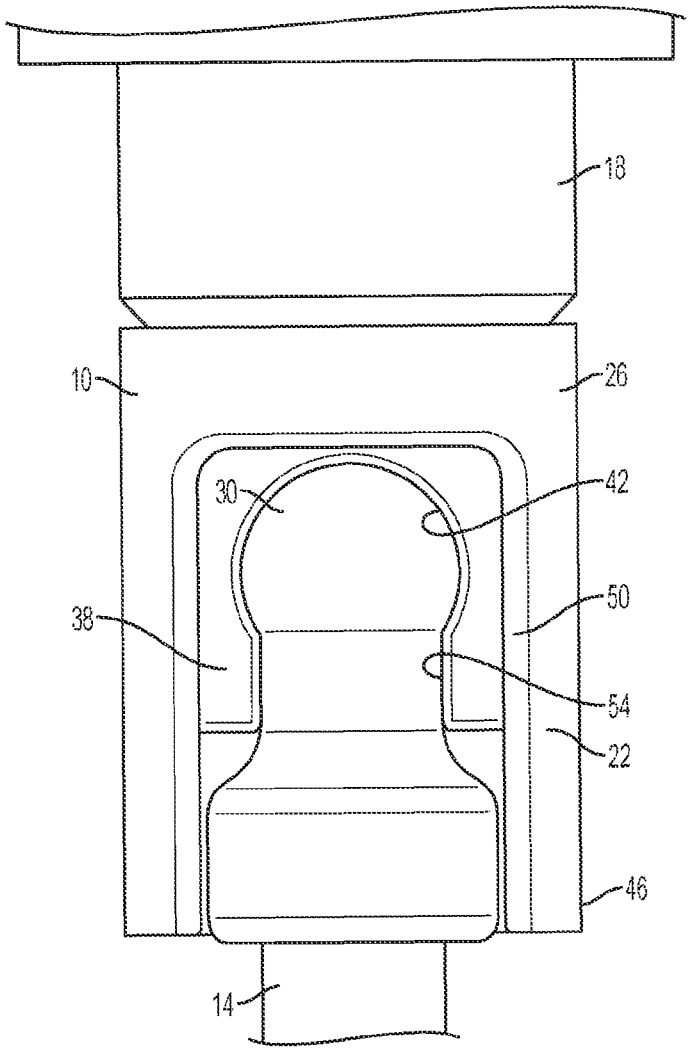
FIG. 2 is a side view of the draw stud connector of FIG. 1 attached to a knockout punch with a second portion in an aligned position.
Figure 3:
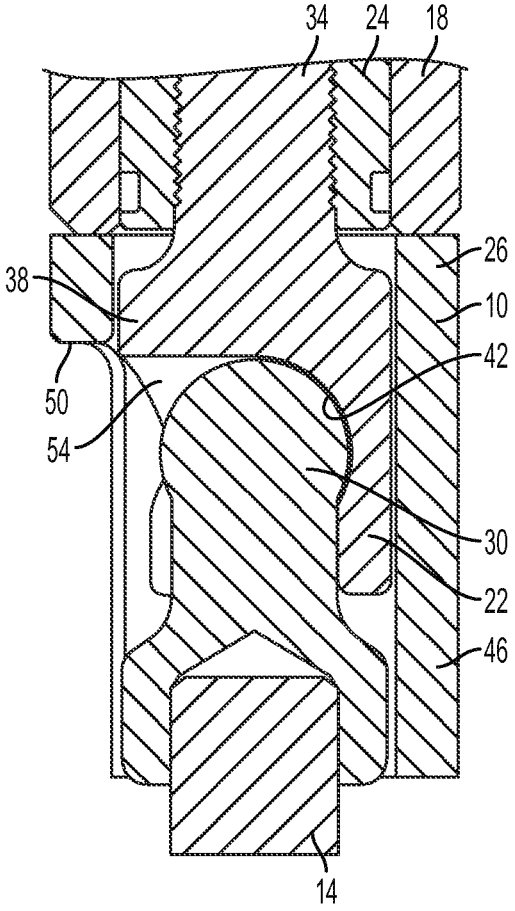
FIG. 3 is a section view taken through the draw stud connector of FIG. 2.
Figure 4:
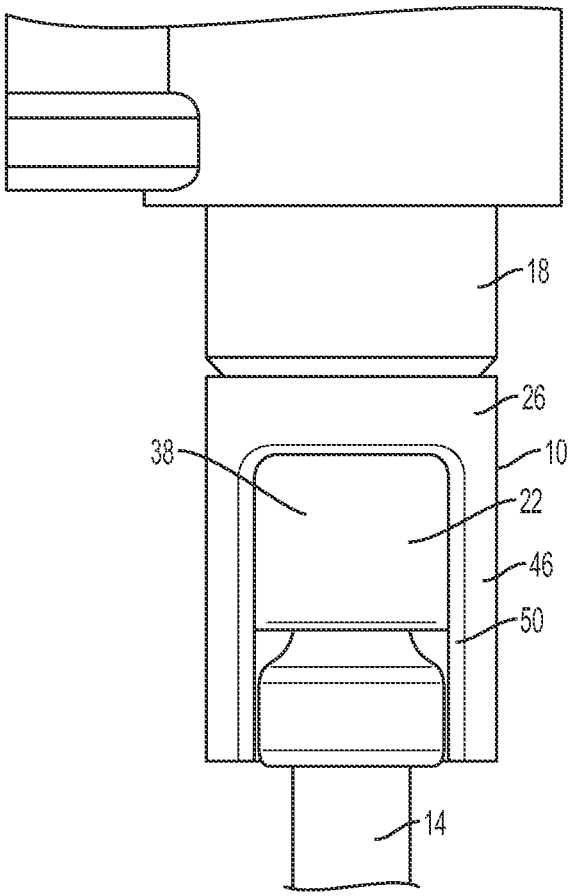
FIG. 4 is a side view of the draw stud connector of FIG. 1 attached to a knockout punch with the second portion in an un-aligned position.
Figure 5:
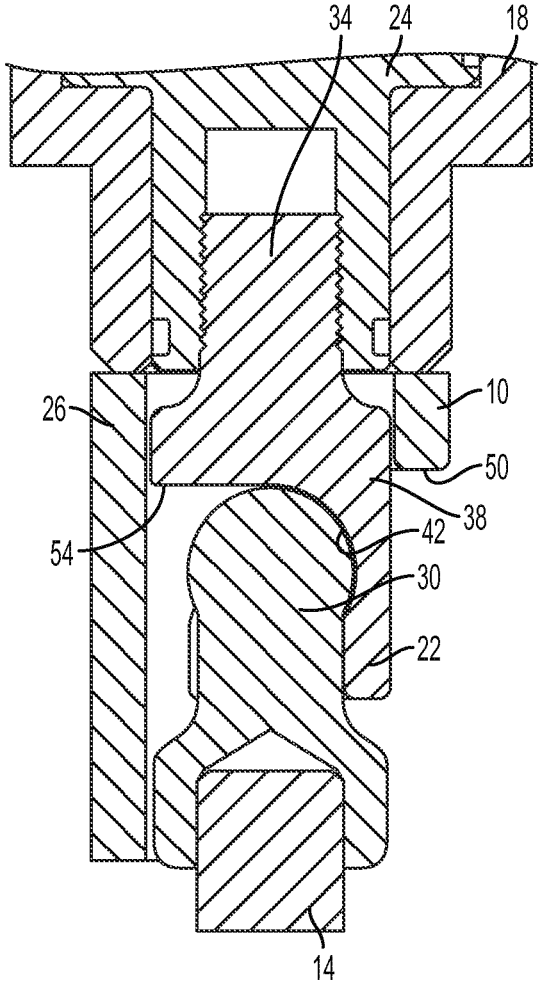
FIG. 5 is a section view taken through the draw stud connector of FIG. 4.

The second portion 26 of the connector 10 at least partially encompasses the first portion 22 of the connector 10. The second portion 26 includes an annular wall 46 that forms a cut-out 50 therein. When assembled, the second portion 26 is rotatable with respect to the first portion 22 between an aligned position (FIGS. 2 and 3) and an un-aligned position (FIGS. 4 and 5). Referring to FIGS. 2 and 3, in the aligned position the cut-out 50 aligns with an open end 54 of the recess 42 to allow insertion and removal of the draw stud 14 from the connector 10. Referring to FIGS. 4 and 5, in the un-aligned position the cut-out 50 does not align with the open end 54 of the recess 42, which prevents insertion or removal of the draw stud 14 from the connector 10.

To attach the draw stud 14 to the knockout punch 18, the user first rotates the second portion 26 into the aligned position. The user then radially introduces the ball end 30 of the draw stud 14 into the recess 42 through the open end 54. The user then rotates the second portion 26 of the connector 10 into the un-aligned position securing the ball end 30 within the recess 42. The user may then use the knockout punch 18.

To detach the draw stud 14 from the knockout punch 18, the user rotates the second portion 26 back to the aligned position and removes the ball end 30 of the draw stud 14 radially from the open end 54 of the recess 42.

FIGS. 6-9 illustrate a draw stud connector 10' according to another embodiment of the invention. The illustrated connector 10' includes much of the same structure and has many of the same properties as that the draw stud connector 10 illustrated in FIGS. 1-8. Common elements have been given the same references numbers, and all elements related to this embodiment include an added prime (') symbol. The following description focuses primarily upon structure and features of the draw stud connector 10' that differ from those discussed above.

Figure 6:
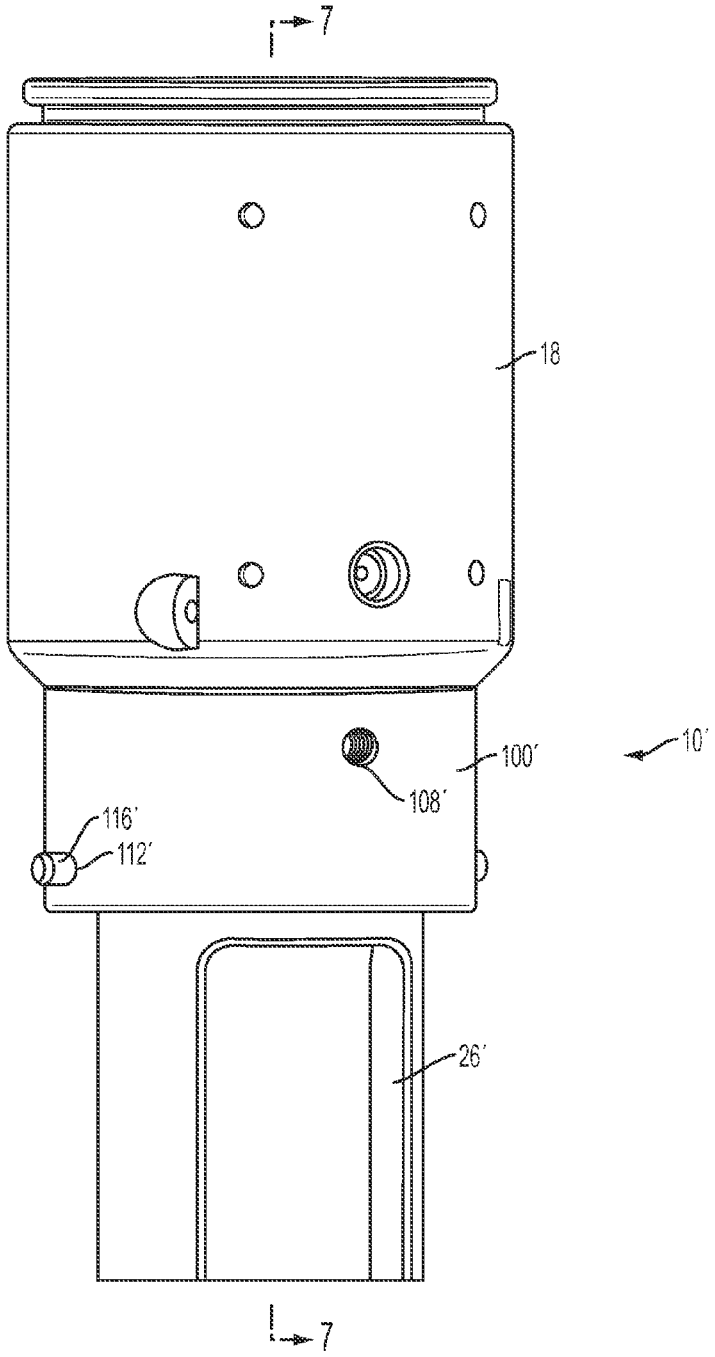
FIG. 6 is a perspective view of a draw stud connector according to another embodiment of the invention, with the connector attached to a knockout punch.
Figure 7:
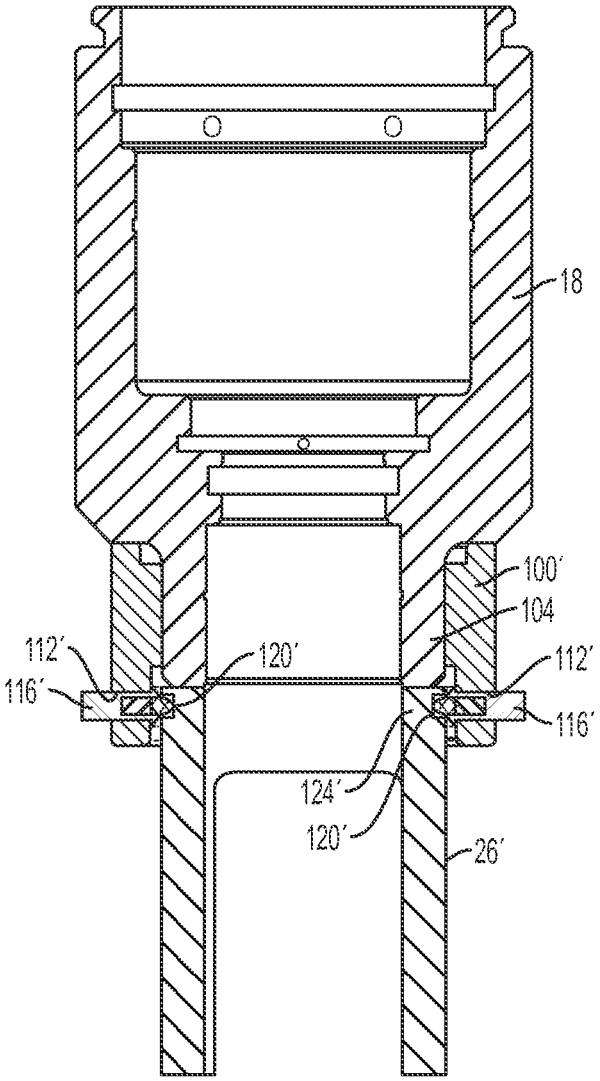
FIG. 7 is a section view taken along line 7-7 of FIG. 6.
Figure 8:
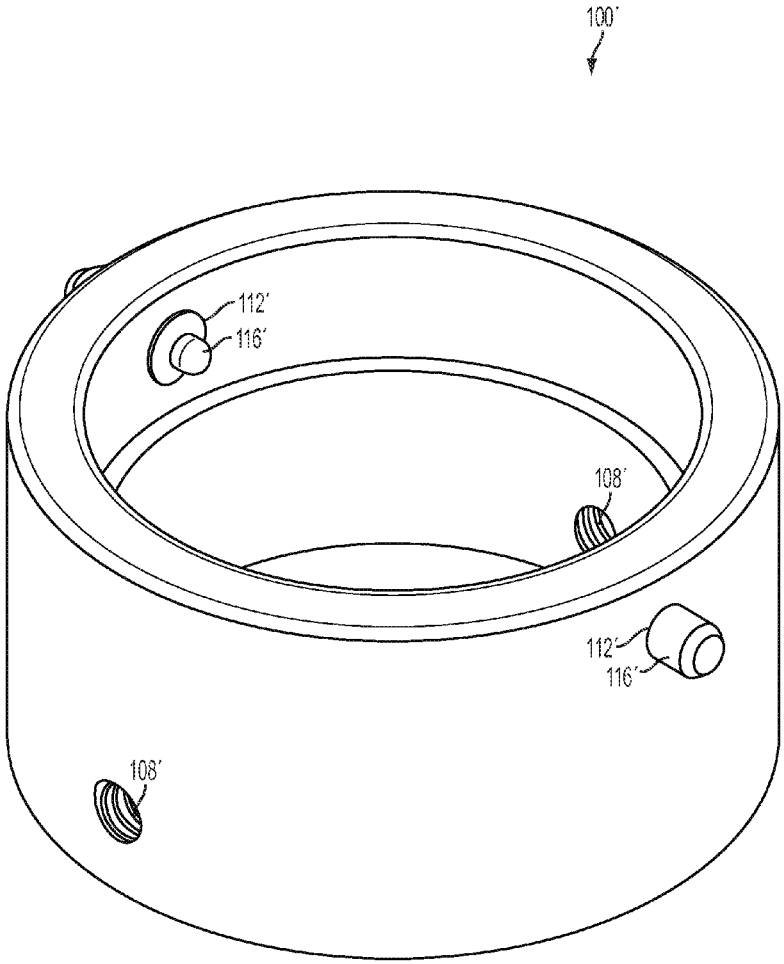
FIG. 8 illustrates a collar of the draw stud connector shown in FIG. 6.

Illustrated in FIGS. 6-8, the draw stud connector 10' includes a collar 100'. The collar 100' is substantially cylindrical in shape, being sized to fit over a foot 104 of the knockout punch 18. The collar 100' includes a first set of apertures 108', spaced equally along a perimeter of the collar and sized to receive a locking screw (not shown) therein. When assembled, the collar 100' is placed over the foot 104 of the knockout punch 18 and secured thereto by tightening the locking screws. Although shown with two locking screws, fewer or more may be present as necessary.

The collar 100' also includes a second set of apertures 112' sized to receive a corresponding pin 116' therein. When assembled, the pins 116' are sized to be at least partially received within a groove 120' of a second cylindrical portion 26' of the connector 10'. In the illustrated embodiment, the collar 100' includes a pair of pins 116' positioned substantially 180 degrees apart, although fewer or more pins may be present as necessary.

Figure 9:
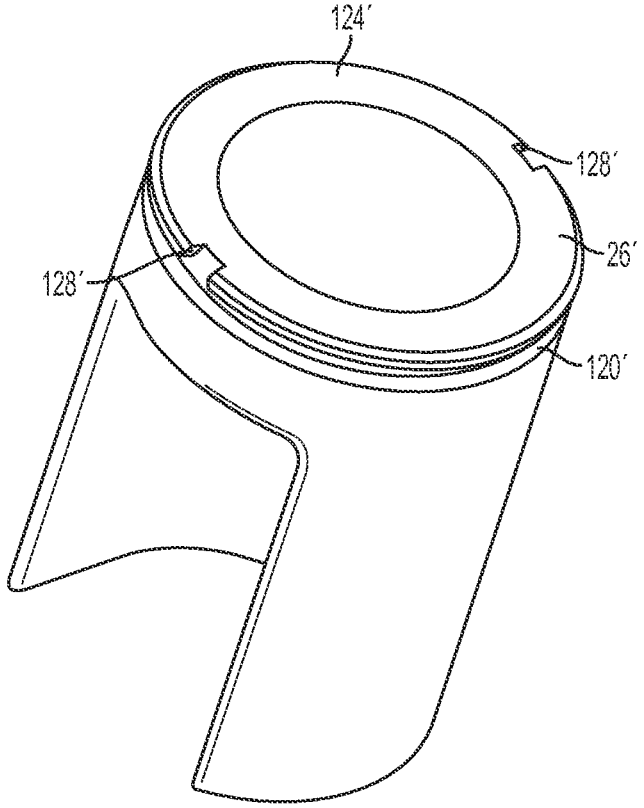
FIG. 9 illustrates a second cylinder portion of the draw stud connector shown in FIG. 6.

Illustrated in FIGS. 6-7 and 9, the second cylindrical portion 26' includes the annular groove 120' extending around a periphery of the cylinder 26', proximate a top 124' of the cylinder 26'. The groove 120' also includes a pair of channels 128', which extend axially between the groove 120' and the top 124'. When assembled, the groove 120' at least partially receives a portion of the pins 116' therein to removeably connect the cylinder 26' to the knockout punch 18. Although not illustrated, the groove 120' may also include a locking mechanism (not shown) to retain the pins 116' within the groove 120'.

To assemble the draw stud connector 10', the user axially introduces the collar 100' over the foot 104 of the knockout punch 18. Once in place, the user tightens each of the locking screws (not shown), securing the collar 100' to the foot 104. The user then axially inserts the top 124' of the second cylindrical portion 26' into the collar 100', making sure to align each pin 116' with a corresponding channel 128'. Once the pins 116' reach the groove 120', the user rotates the cylindrical portion 26' with respect to the collar 100' causing the pins 116' to slide along the groove 120' and lock the cylinder 26' in place.

To disassemble the draw stud connector 10', the user rotates the cylinder 26' until each pin 116' aligns with its corresponding channel 128'. The user then axially removes the cylinder 26' from the collar 100'. To remove the collar 100', the user loosens the locking screws (not shown) and axially removes the collar from the foot 104.

FIGS. 10-13 illustrate a draw stud connector 10" according to yet another embodiment of the invention. The illustrated draw stud connector 10" includes much of the same structure and has many of the same properties as that the draw stud connectors 10, 10' illustrated in FIGS. 1-9. Common elements have been given the same references numbers with an added double prime (") symbol. The following description focuses primarily upon structure and features of the draw stud connector 10" that differ from those discussed above.

Figure 10:
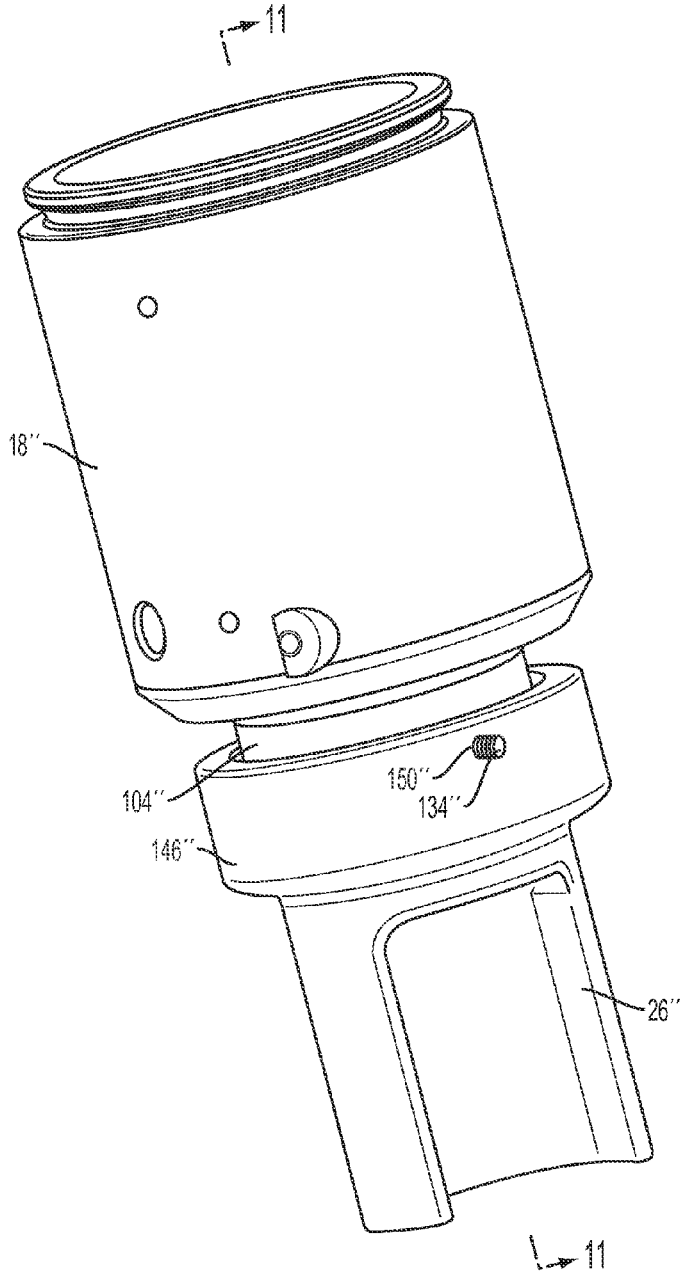
FIG. 10 is a perspective view of a draw stud connector according to yet another embodiment of the invention, with the connector attached to a knockout punch.
Figure 11:
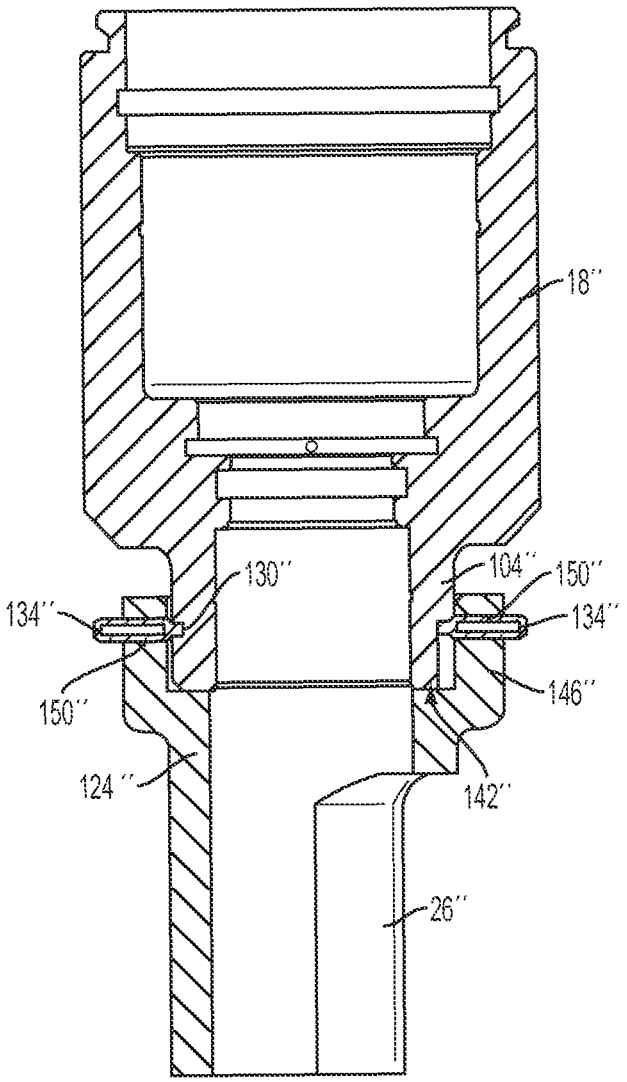
FIG. 11 is a section view taken along line 11-11 of FIG. 10.
Figure 12:
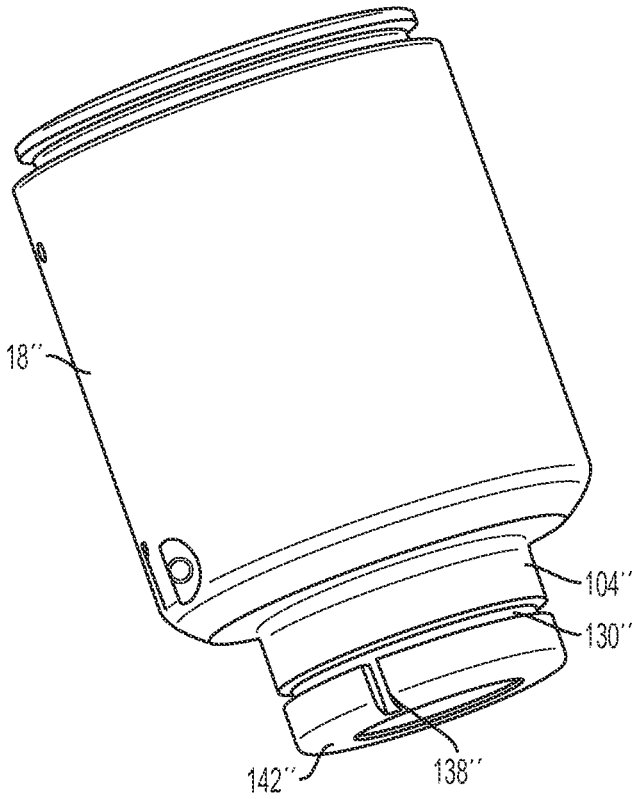
FIG. 12 illustrates the knockout punch of FIG. 10, with the draw stud connector removed.

Illustrated in FIGS. 10-12, a foot 104" of the knockout punch 18" includes an annular groove 130" extending along a periphery of the foot 104". The groove 130" is sized to receive at least a portion of a pin 134" therein. The groove 130" also includes a pair channels 138" extending axially between the groove 130" and a contact surface 142" of the foot 104". The groove 130" may also include a locking mechanism to secure the pins 134" therein.

Figure 13:
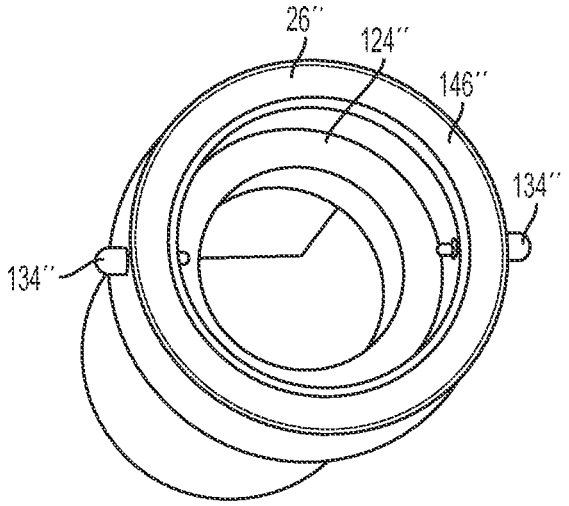
FIG. 13 illustrates a second cylinder portion of the draw stud connector shown in FIG. 10.

Illustrated in FIGS. 10, 11 and 13, the second cylindrical portion 26" includes an extension 146" extending axially from a top 124" of the cylinder 26" at an increased diameter. In the illustrated embodiment, the extension 146" includes an inner diameter substantially corresponding to an outer diameter of the foot 104" of the knockout punch 18".

The extension 146" includes a first set of apertures 150", each sized to receive a corresponding pin 134" therein. In the illustrated embodiment, the pins 134" are spaced generally 180 degrees from one another. When assembled, the pins 134" are at least partially received within the groove 130" of the foot 104" to removeably couple the second cylindrical portion 26" to the knockout punch 18".

To assemble the draw stud connector 10", the user axially introduces the second cylinder portion 26" onto the foot 104", making sure to align each pin 134" with a corresponding channel 138". Once the extension 146" at least partially encompasses the foot 104" and the pins 134" have entered the groove 130", the user then rotates the cylinder 26" with respect to the foot 104", causing the pins 134" to move along the groove 130" and lock the cylinder 26" with respect to the knockout punch 18".

To remove the draw stud connector 10", the user rotates the cylinder 26" with respect to the foot 104" until each pin 134" aligns with a corresponding channel 138". The user then axially removes the cylinder 26" from the foot 104".

In a further embodiment, the pins 134" may be spring loaded, allowing the pins to radially retract into the extension 146" of the cylinder 26". In such an embodiment, the cylinder 26" may be axially introduced onto the foot 104" regardless of whether or not the pins 134" align with the channels 138". To remove the cylinder 26", the user would use the same steps as described above.

FIGS. 14-18 illustrate a draw stud connector 10'" according to another embodiment of the invention. The illustrated connector 10'" includes much of the same structure and has many of the same properties as the draw stud connector 10 illustrated in FIGS. 1-8. Common elements have been given the same references numbers with an added prime ('") symbols. The following description focuses primarily upon structure and features of the draw stud connector 10'" that differ from those discussed above.

Illustrated in FIGS. 14-18, a second cylindrical portion 26'" defines an axis 196'" and includes a flange 200'" extending radially therefrom. The flange 200'" is substantially disk shaped and defines spring seats 204'" (e.g., three). When assembled, the spring seats 204'" each at least partially receive one end of a biasing spring 208'" therein.

The second cylindrical portion 26'" also includes an annular wall 212'" extending axially outwardly from the flange 200'". The annular wall 212'" is sized to fit over the foot 104 of the knockout punch 18. The annular wall 212'" includes apertures 216'", each spaced evenly along the circumference of the wall. When the draw stud connector 10'" is assembled, each aperture 216'" at least partially receives a lock ball 220'" therein.

The annular wall 212'" defines a snap groove 224'" configured to receive at least a portion of a snap ring 226'" therein. The snap groove 224'" extends circumferentially along an outer surface 214'" of the annular wall 212'" and is spaced axially further from the flange 200'" than the apertures 216'".

The second cylindrical portion 26'" also includes a locking collar 228'" slidably coupled to the second portion 26'" and movable between an unlocked position (FIG. 15), where the foot 104 of the knockout punch 18 may be received within the annular wall 212'", and a locked position (FIG. 14), where the foot 104 is retained within the annular wall 212'". The foot 104 is also blocked from entering the annular wall 212'" when the collar 228'" is in the locked position. In the illustrated construction, the locking collar 228'" is biased towards the locked position by the biasing springs 208'".

Figure 17:
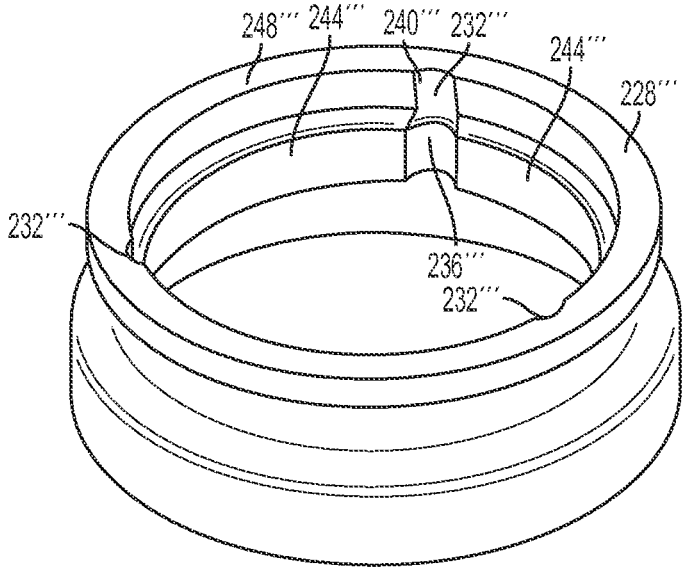
FIG. 17 is a perspective view of a locking collar of the connector of FIG. 14.
Figure 18:
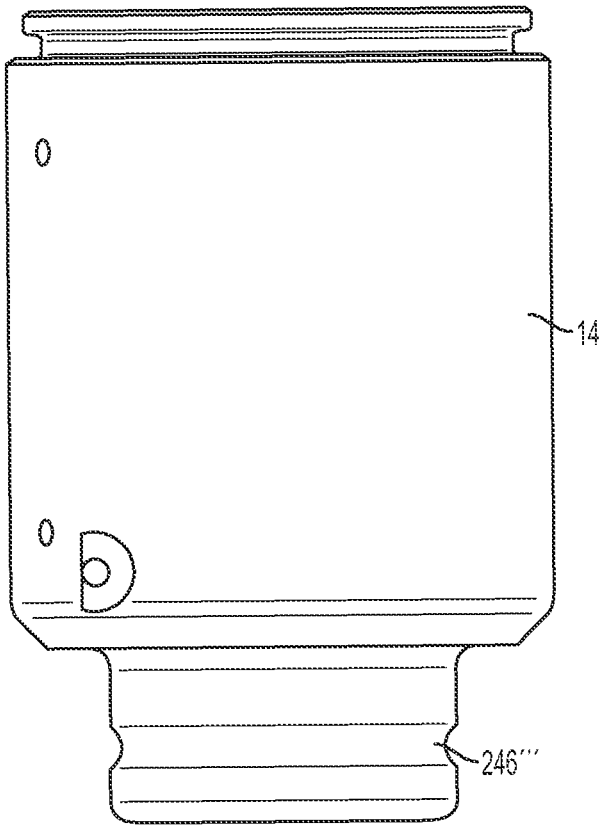
FIG. 18 illustrates the knockout punch of FIG. 14, with the connector removed.
Figure 19:
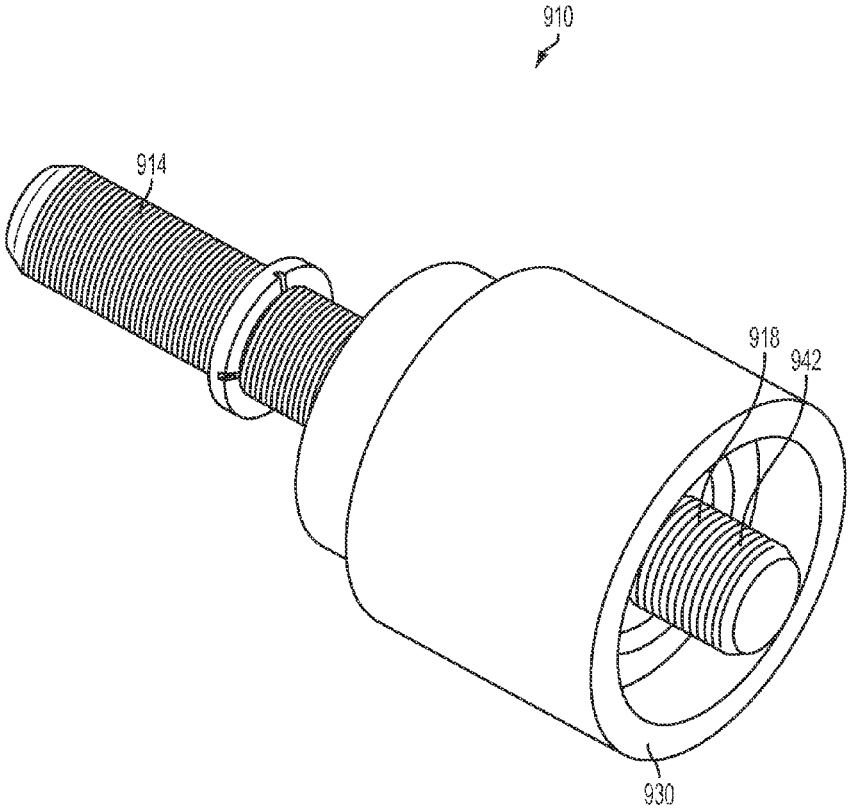
FIG. 19 is a perspective view of a draw stud connector according to one embodiment of the invention.

In the illustrated embodiment, the locking collar 228'" is substantially annular in shape and sized to slide axially along the outer surface 214'" of the annular wall 212'". The locking collar 228'" includes locking ball retention slots 232'" (e.g., three), each extending axially along the inner surface of the collar 228'" and sized to receive at least a portion of a corresponding locking ball 220'" therein (FIG. 17). When the draw stud connector 10'" is assembled, each retention slot 232'" is substantially aligned with a corresponding one of the apertures 216'" of the annular wall 212'".

Each retention slot 232'" includes a first portion 236'" spaced a first radial distance from the axis 196'", and a second portion 240'" spaced a second radial distance, greater than the first distance, from the axis 196'". During use, each locking ball 220'" slides along a corresponding retention slot 232'" as the collar 228'" moves between the locked and unlocked positions. More specifically, each locking ball 220'" is aligned with the first portion 236'" when the collar 228'" is in the locked position, and each locking ball 220'" is aligned with the second portion 240'" when the collar 228'" is in the unlocked position.

Figure 14:
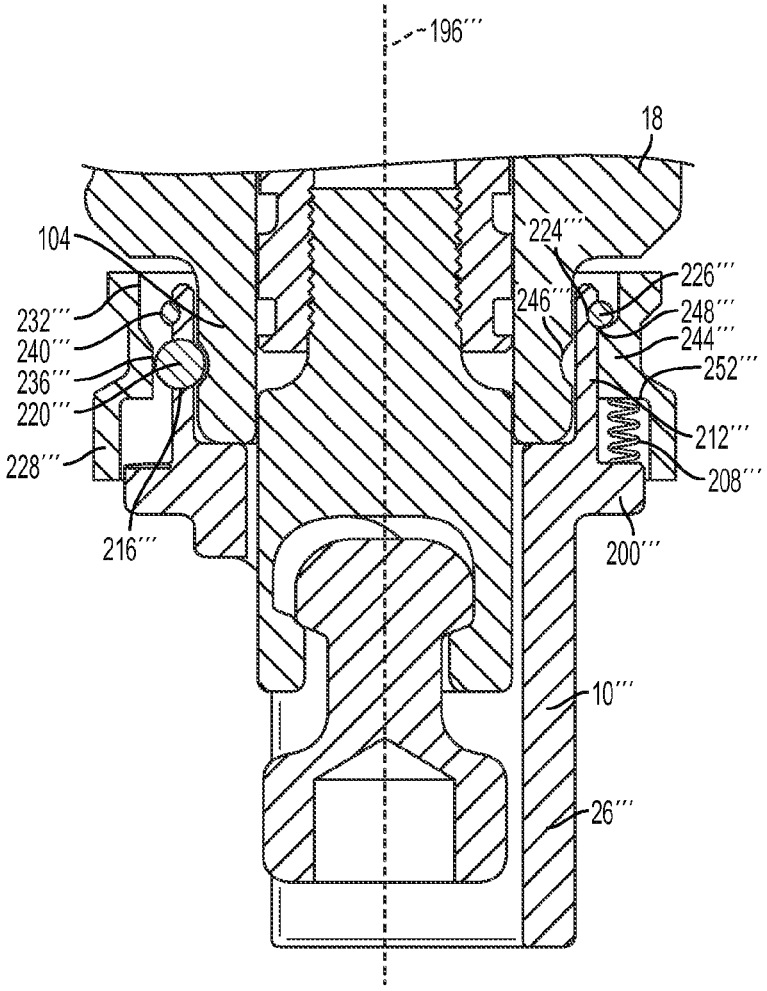
FIG. 14 is a section view taken along a center axis of a draw stud connector according to yet another embodiment of the invention, with the connector attached to a knockout punch and in a locked position.
Figure 15:
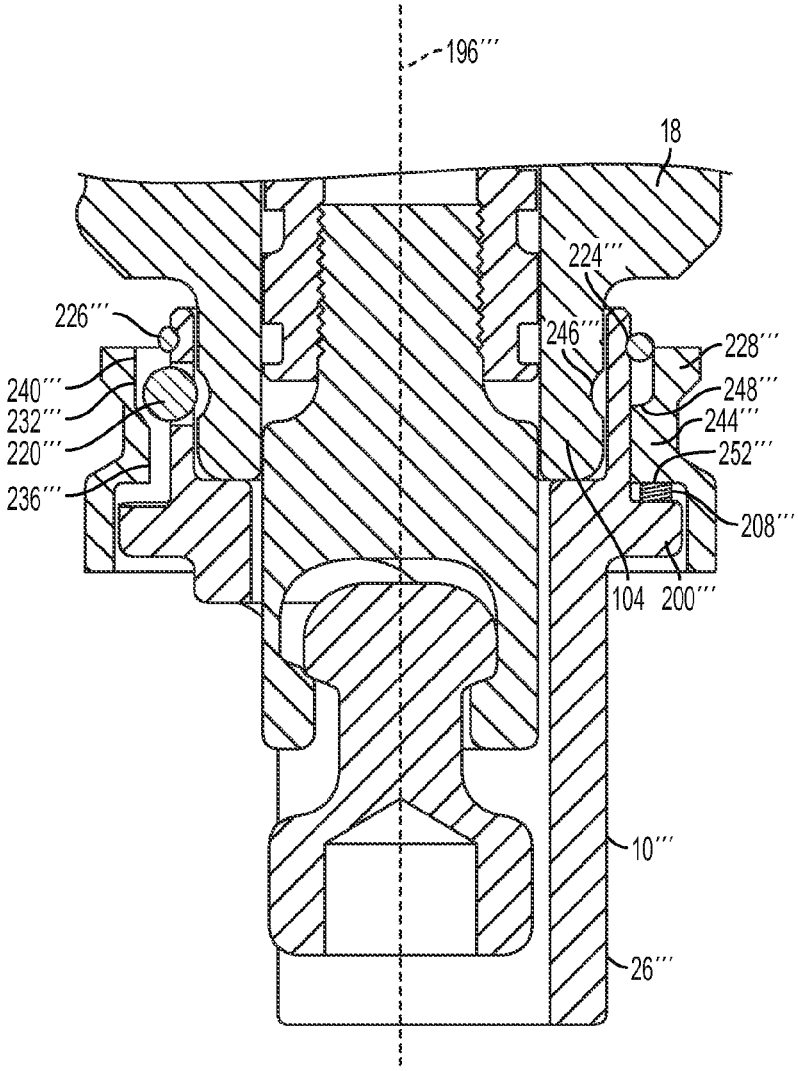
FIG. 15 is a perspective view of the connector of FIG. 14 with the connector in an unlocked configuration.
Figure 16:
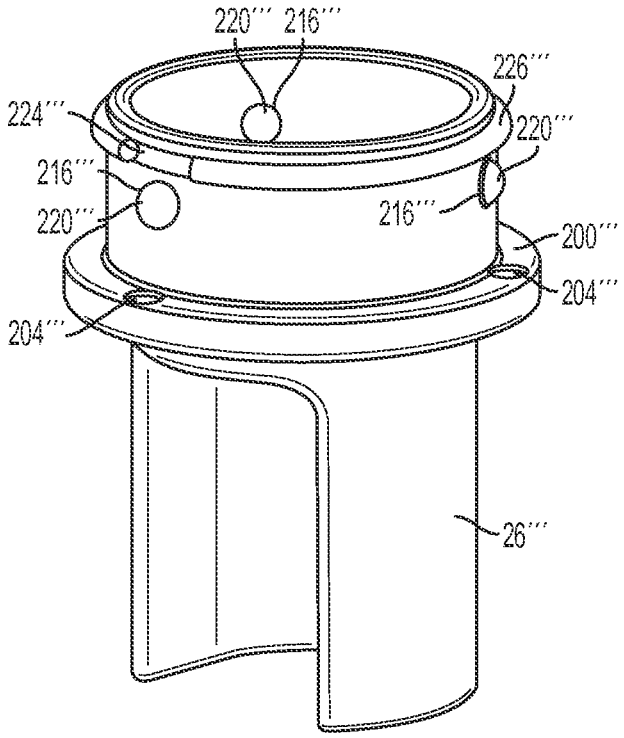
FIG. 16 is a perspective view of a second cylindrical member of the connector of FIG. 14.

The locking collar 228'" also includes a ridge 244'" extending radially inwardly therefrom. The ridge 224'" defines a first axial surface 248'" configured to contact the snap ring 226'" positioned within the snap ring groove 224'" (FIGS. 14 and 15). When assembled, the first axial surface 248'" and the snap ring 226'" are configured to act as a stop, limiting the axial distance the collar 228'" can travel with respect to the second cylindrical portion 26'".

The ridge 224'" also defines a second axial surface 252'" opposite the first axial surface 248'" (FIGS. 14 and 15). When the second cylindrical portion 26'" is assembled, the spring members 208'" are seated on the second axial surface 252'".

The second cylindrical portion 26'" also includes locking balls 220'" (e.g., three). When assembled, each locking ball 220'" is received within a corresponding aperture 216'" of the annular wall 212'" and a corresponding retention slot 232'" of the collar 228'". During use, the outermost radial position of the locking balls 220" are limited by the retention slots 232'".

To assemble the draw stud connector 10'", the user axially biases the collar 228'" into the unlocked position (FIG. 15). By doing so, the second portion 240'" of the retention slots 232'" are aligned with the lock balls 220'", allowing the lock balls 220'" to move radially outwardly. As such, the radially inward edge of the lock balls 220'" are clear of the inner surface of the annular wall 212'" (FIG. 15). The user then introduces the foot 104 of the knockout punch 18 into the annular wall 212'" and seats it accordingly. Once in place, the user releases the collar 228'", causing the spring members 208'" to bias the collar 228'" back into the locked position (FIG. 14). As such, the lock balls 220'" are aligned with the first portion 236'" of the retention slots 232'", causing the balls 220'" to be biased radially inwardly. This in turn causes the balls 220'" to enter the groove 246'" formed in the outer surface of the foot 104. Once locked, the second cylindrical member 26'" is able to rotate with respect to the foot 104 while being axially locked with respect to the foot 104. Therefore, the user is able to rotate the second cylindrical member 26'" to lock and unlock the connector 10'", as described above.

To disassemble the draw stud connector 10'", the user biases the collar 228'" into the unlocked position (FIG. 15). By doing so, the second portion 240'" of the retention slots 232'" re-align with the lock balls 220'", allowing them to move radially outwardly and out of the groove 246'". The user is then able to axially remove the second cylindrical member 26'" from the foot 104.

Figure 20:
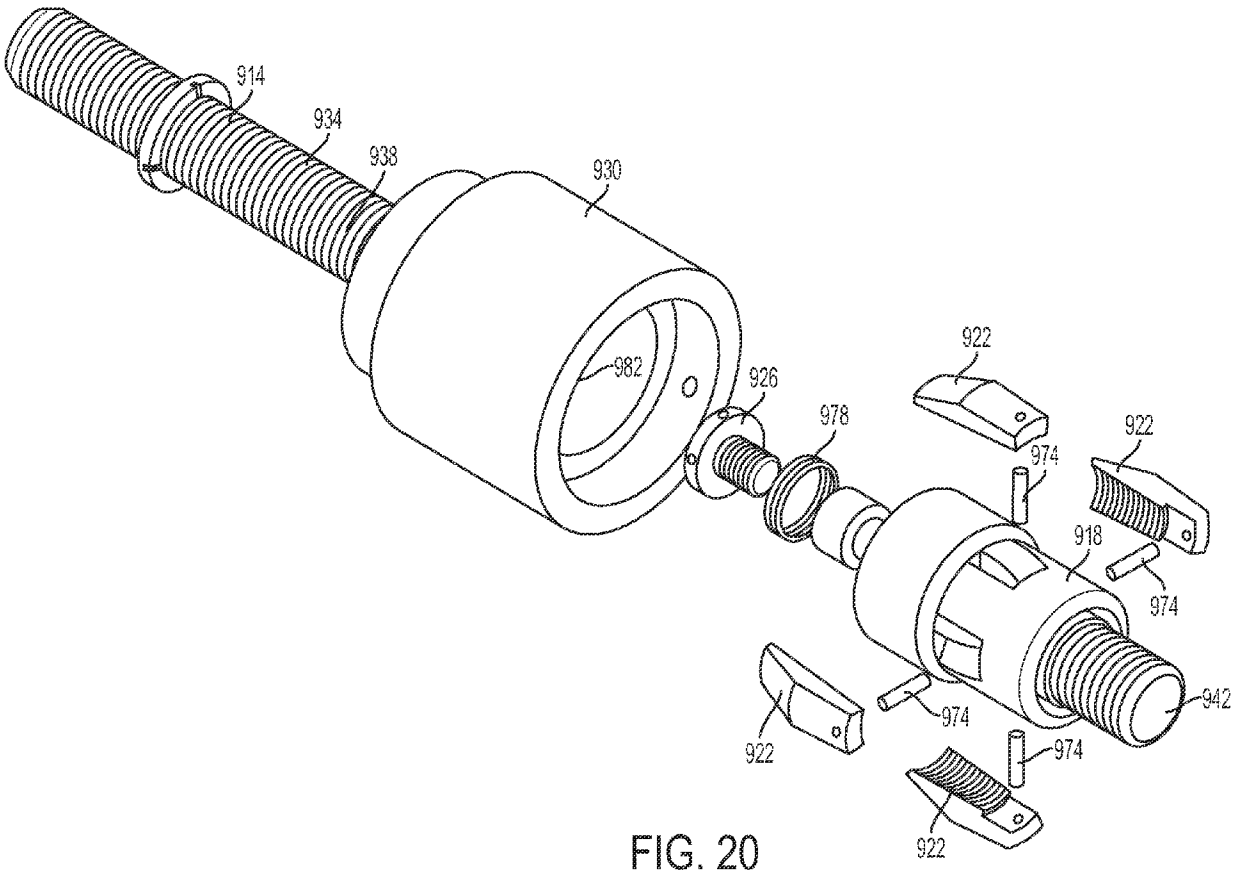
FIG. 20 is an assembly view of the draw stud connector of FIG. 19.

FIGS. **19-24*b* illustrate another construction of a draw stud connector 910 configured to couple a draw stud 914 to a punching device, such as a knockout punch (not shown). The connector 910 includes a body 918, wedges 922 positioned and moveable within the body 918, a plate 926 coupled to the wedges 922, and an outer housing 930. In the illustrated embodiment, the draw stud connector 910 is configured to be used with a draw stud 914 having a threaded portion 934 positioned proximate a first end 938 (FIG. 20**).

Figure 22A:
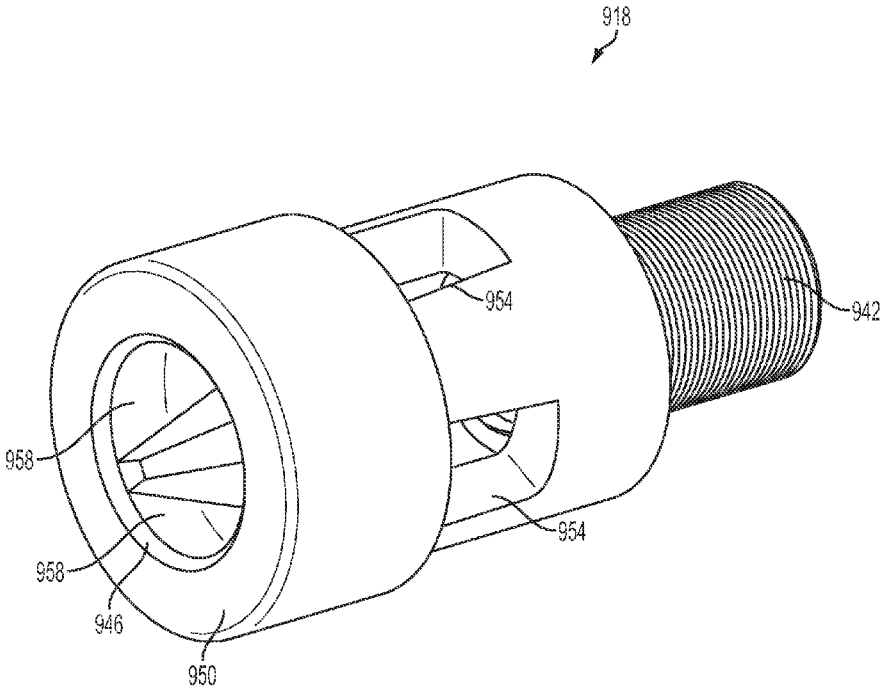
FIG. 22*a* is a perspective view of a body of the draw stud of FIG. 19.
Figure 22B:
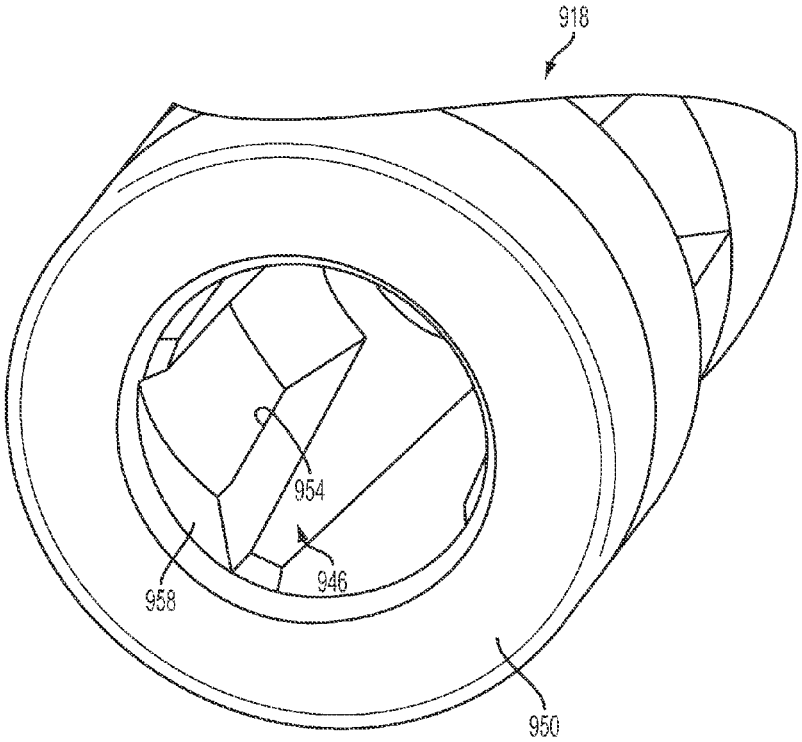
FIG. 22*b* is a detailed view of the body of FIG. 22*a*.
Figure 23:
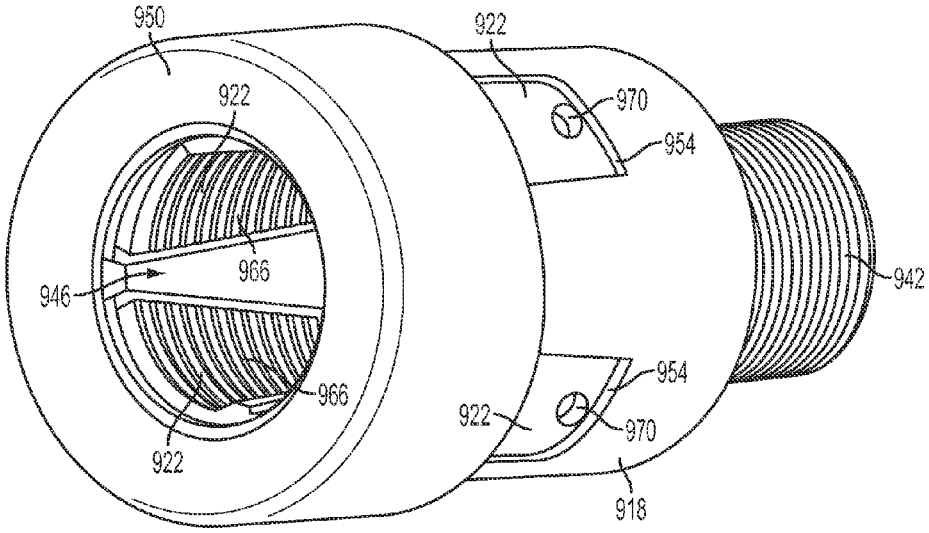
FIG. 23 is a perspective view of the body of FIG. 22*a*, including a set of wedges.

Referring to FIGS. **22*a*-23, the body 918 of the connector 910 is substantially cylindrical in shape and includes a threaded end 942 for coupling with the piston (not shown) of a knockout punch such that the body 918 and the piston move as a unit. The body 918 defines a recess 946 extending axially inwardly from a first end 950 of the body 918, generally opposite the threaded end 942. The recess 946 includes four windows 954, each sized to receive a corresponding one of the wedges 922 therein. The windows 954 also include a corresponding ramped portion 958 (FIG. 22***b*) positioned proximate the first end 950 of the body 918 to radially position the wedges 922 within the body 918. In further embodiments, fewer or more windows and wedges may be used.

When assembled, the ramped portion 958 of each window 954 is configured such that when the wedges 922 move towards the first end 950 of the body 918, the wedges 922 are biased radially inwardly, and when the wedges 922 move away from the first end 950, the wedges 922 are allowed to move radially outwardly.

Figure 24A:
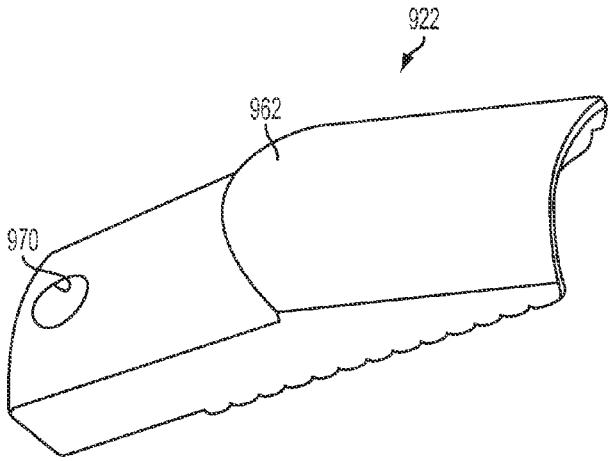
FIG. 24*a* is a perspective view of a wedge of the draw stud connector of FIG. 19.
Figure 24B:
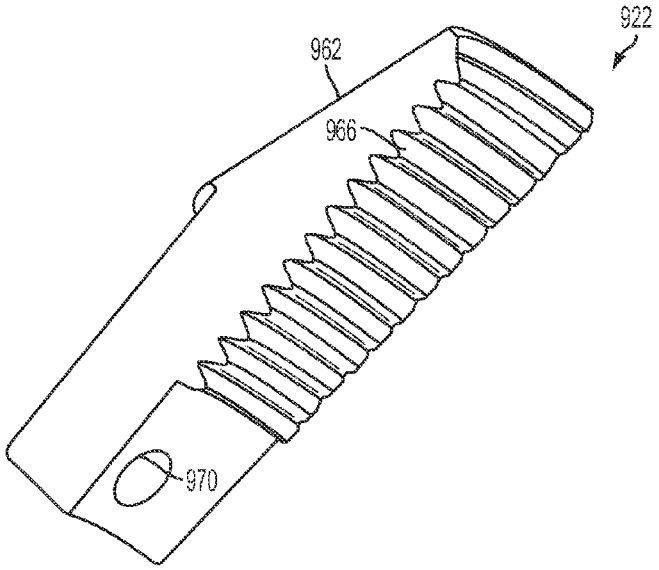
FIG. 24*b* is a rear perspective view of the wedge of FIG. 24*a*.

Referring to FIGS. 24*a* and 24*b*, each wedge 922 of the connector 910 is substantially triangular in shape. Each of the wedges includes an angled surface 962 configured to contact the ramped portion 958 of the body 918 and a toothed portion 966, opposite the angled surface 962, having teeth sized to engage the threaded portion 934 of the draw stud 914. Each of the wedges 922 also includes an aperture 970 sized to at least partially receive a pin 974 therein. When assembled, each wedge 922 is positioned and moves within a corresponding window 954 of the body 918. In the illustrated embodiment, each wedge 922 is biased towards the first end 950 of the body 918 by a biasing member 978 (described below).

Referring to FIG. 20, the plate 926 of the connector 910 is positioned within the recess 946 of the body 918 and is connected to each of the wedges 922 by the respective pin 974. When assembled, the plate 926 acts as a guide, aligning each wedge 922 axially with one another while also facilitating movement of the wedges 922 as a unit. In the illustrated embodiment, the plate 926 is substantially cylindrical in shape; however other shapes may be used. When assembled, each of the pins 974 is pressed into the plate 926, but moveable with respect to the wedges 922 to compensate for changes in radial position between the wedges 922 and the plate 926.

The connector 910 also includes a biasing spring 978 (FIG. 20) positioned between the body 918 and the plate 926 to bias the wedges 922 towards the first end 950 of the body 918.

Referring to FIG. 20, the outer housing 930 of the connector 910 is substantially cylindrical in shape and has an aperture 982 extending therethrough. When assembled, the outer housing 930 is coupled to the knockout punch such that it substantially encompasses the body 918. The outer housing 930 includes a bottom surface 986 that is configured to contact the die (not shown) during operation of the punch. More specifically, the outer housing 930 transmits forces between the die and the knockout punch while bypassing the body 918.

Figure 21:
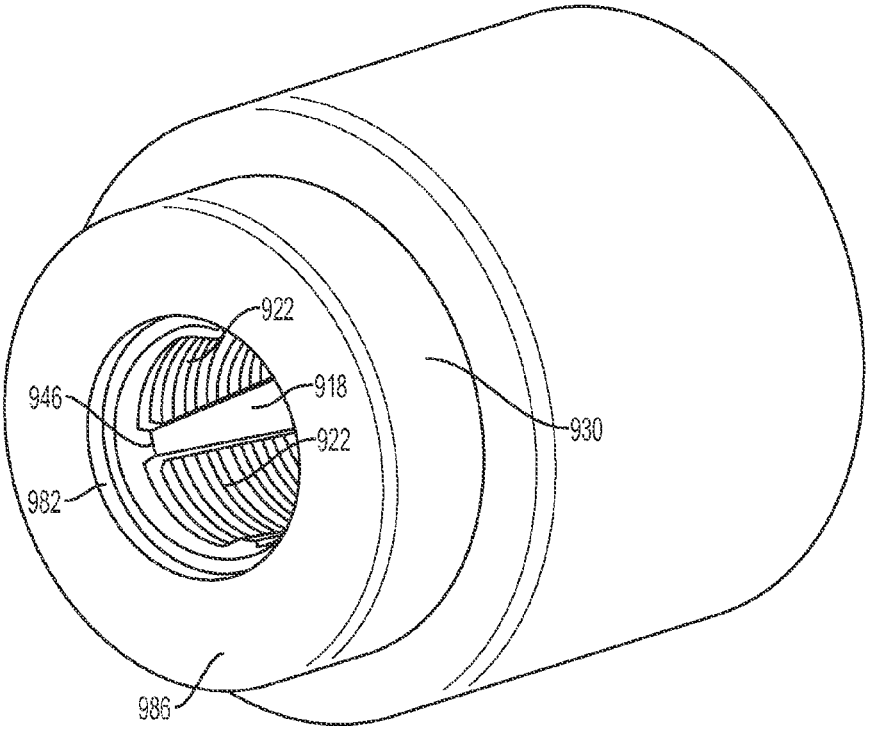
FIG. 21 is a perspective view of the draw stud connector of FIG. 19 with the draw stud removed.

To couple the draw stud 914 to the knockout punch, the user introduces the first end 938 of the draw stud 914 into the recess 946 of the body 918. With the outer housing 930 installed, this also entails inserting the first end 938 of the draw stud 914 through the aperture 982 (FIG. 21).

As the draw stud 914 enters the recess 946, the first end 938 of the stud 914 contacts the wedges 922, which are naturally positioned proximate the first end 950 of the body 918 (described above). As the draw stud 914 engages the wedges 922, the wedges 922 are biased away from the first end 950 of the body 918, thereby moving radially outwardly to produce sufficient clearance for the draw stud 914 to continue moving axially into the recess 946. As this occurs, the toothed portion 966 of the wedges 922 continuously re-engages the threaded portion 934 of the draw stud 914 as the draw stud 914 advances.

Once the draw stud 914 is completely inserted into the recess 946 any attempts at removing the draw stud 914 will cause the wedges 922 to clamp down onto the draw stud 914, thereby restricting its removal from the recess 946. More specifically, with the toothed portion 966 of the wedges 922 engaged with the threaded portion 934 of the draw stud 914, any attempt at removing the draw stud 914 biases the wedges 922 towards the first end 950 of the body 918, causing the wedges 922 to move radially inwardly and increase the grip on the draw stud 914. As such, the larger the force trying to remove the draw stud 914 from the recess, the greater the clamping force produced by the wedges 922. Stated differently, the connector 910 allows the draw stud 914 to move into the recess 946, but restricts removal of the draw stud 914.

To remove the draw stud 914 from the connector 910, the user rotates the draw stud 914 in a counter-clockwise direction, unscrewing it from the wedges 922.

Although the invention has been described in detail with reference to certain preferred embodiments, variations and modifications exist within the scope and spirit of one or more independent aspects of the invention as described.

The invention claimed is:

1. An assembly for use with a punching device having a body and a working piston movable with respect to the body, the assembly comprising:

a draw stud including a first end and a threaded second end for attachment with a punch; and a draw stud connector including a first member removably couplable to the working piston and defining an axis therethrough, wherein the first member includes a recess with a radial opening and a separate axial opening, wherein a width of the radial opening is greater than a width of the first end of the draw stud such that the first end of the draw stud can be introduced and removed radially from the recess, and wherein a width of the axial opening is less than the width of the first end of the draw stud such that the first end cannot be removed axially from the recess.

2. The assembly of claim 1, wherein the draw stud connector further includes a second member removably coupled to the body of the punching device and adjustable with respect to the first member between a locked position, where the first end of the draw stud cannot be removed from the recess, and an unlocked position, where the first end of the draw stud can be removed from the recess through the radial opening.

3. The assembly of claim 2, wherein the second member includes an annular wall defining a cut out.

4. The assembly of claim 3, further comprising a locking collar coupled to the second member and movable between a locked position and an unlocked position.

5. The assembly of claim 4, wherein the locking collar defines a locking groove, and wherein the locking groove includes a first portion, spaced a first radial distance from the axis, and a second portion, spaced a second greater distance from the axis.

6. The assembly of claim 5, wherein the second member includes a lock ball, and wherein the lock ball aligns with the first portion when the collar is in the lock position, and wherein the lock ball aligns with the second portion when the collar is in the unlocked position.

7. The assembly of claim 1, wherein the first end of the draw stud is ball shaped.

8. The assembly of claim 1, wherein the recess of the first member is substantially spherical in shape.

9. The assembly of claim 8, further comprising a second member defining a cut out, and wherein the second member is movable between an unlocked position, where the cut out is at least partially aligned with the radial opening of the recess, and a locked position, where the cut out is not aligned with the radial opening of the recess.

10. A draw stud connector for use with a punching device having a body and a working piston movable with respect to the body, the draw stud connector comprising:

a first portion removably couplable to the working piston and defining an axis therethrough, the first portion defining a recess with a radial opening; and a second portion removably couplable to the body and defining a cut out, wherein the second portion is rotatable between a first position, where the cut out at least partially aligns with the radial opening, and a second position, where the cut out does not align with the radial opening.

11. The draw stud connector of claim 10, wherein the second portion includes an annular wall defining an aperture, and wherein the draw stud connector further comprises:

a locking collar defining a retention slot, the retention slot having a first portion spaced a first radial distance from the axis, and a second portion spaced a second radial distance from the axis greater than the first radial distance, and a lock ball at least partially positioned within the aperture.

12. The draw stud connector of claim 11, wherein the locking collar is movable between a locked position and an unlocked position, and wherein the first portion of the retention slot aligns with the lock ball in the locked position, and wherein the second portion of the retention slot aligns with the lock ball in the unlocked position.

13. The draw stud connector of claim 10, wherein the recess is substantially spherical in shape.

14. The draw stud connector of claim 10, wherein the recess also includes an axial opening.

15. The draw stud connector of claim 14, wherein a first end of a draw stud is capable of being introduced and removed from the recess through the radial opening, but the first end cannot be removed from the recess through the axial opening.

16. The draw stud connector of claim 15, wherein the first end is substantially ball shaped.

17. The draw stud connector of claim 10, wherein the second portion at least partially encompasses the first portion.

18. The draw stud connector of claim 10, wherein the first portion is threadably coupled to the working piston.

19. The draw stud connector of claim 10, wherein the second portion is rotatable about the axis between the first position and the second position.

20. A knockout punch comprising:

a body;

a working piston movable with respect to the body;

a draw stud including a first end and a threaded second end for attachment with a punch; and a draw stud connector including a first portion removably couplable to the working piston and defining an axis therethrough, the first portion defining a recess with a radial opening, and a second portion removably couplable to the body and defining a cut out, wherein the second portion is rotatable between a first position, where the cut out at least partially aligns with the radial opening, and a second position, where the cut out does not align with the radial opening.

21. The knockout punch of claim 20, wherein the second portion also includes an annular wall defining an aperture, and wherein the knockout punch further comprises:

a locking collar defining a retention slot, the retention slot having a first portion spaced a first radial distance from the axis, and a second portion spaced a second radial distance from the axis greater than the first radial distance, and a lock ball at least partially positioned within the aperture.

22. The knockout punch of claim 21, wherein the locking collar is movable between a locked position and an unlocked position, and wherein the first portion of the retention slot aligns with the lock ball in the locked position, and wherein the second portion of the retention slot aligns with the lock ball in the unlocked position.

* * * * *